US008482489B2

(12) United States Patent
Lin et al.

(10) Patent No.: US 8,482,489 B2
(45) Date of Patent: Jul. 9, 2013

(54) SYSTEMS FOR DISPLAYING IMAGES AND MANUFACTURING METHODS FOR DISPLAY PANELS

(75) Inventors: Pao-Ju Lin, Miaoli County (TW); Hung-Yi Luo, Sanchong (TW); Hsin-Hsu Shen, Miaoli County (TW); Chien-Feng Lee, Fongshan (TW); Yen-Liang Shen, Tainan (TW)

(73) Assignee: Chimei Innolux Corporation (TW)

( * ) Notice: Subject to any disclaimer, the term of this patent is extended or adjusted under 35 U.S.C. 154(b) by 1014 days.

(21) Appl. No.: 12/511,610

(22) Filed: Jul. 29, 2009

(65) Prior Publication Data

US 2010/0045572 A1 Feb. 25, 2010

(30) Foreign Application Priority Data

Aug. 19, 2008 (TW) ..... 97131559 A

(51) Int. Cl.
*G09G 3/20* (2006.01)

(52) U.S. Cl.
USPC ..... 345/55; 345/100; 349/139; 365/210.1

(58) Field of Classification Search
USPC ..... 345/55, 87–100; 349/40, 139, 140; 365/210.1
See application file for complete search history.

(56) References Cited

U.S. PATENT DOCUMENTS

| | | | | |
|---|---|---|---|---|
| 5,404,045 | A * | 4/1995 | Mizushima | 257/698 |
| 7,403,193 | B2 * | 7/2008 | Ootsu et al. | 345/204 |
| 7,619,709 | B2 * | 11/2009 | Kang et al. | 349/139 |
| 7,982,705 | B2 * | 7/2011 | Morii | 345/100 |
| 8,089,439 | B2 * | 1/2012 | Ootsu et al. | 345/87 |
| 2003/0122989 | A1 * | 7/2003 | Park et al. | 349/43 |

FOREIGN PATENT DOCUMENTS

CN 1529197 9/2004

OTHER PUBLICATIONS

Office Action dated Jul. 31, 2012 from corresponding application No. CN 200810147281.8.

* cited by examiner

*Primary Examiner* — Kimnhung Nguyen
(74) *Attorney, Agent, or Firm* — Lowe Hauptman Ham & Berner, LLP

(57) ABSTRACT

A system for displaying images is provided and includes a plurality of first signal lines, a plurality of second signal lines, a display area, and a first dummy line. The second signal lines are interlaced with the first signal lines. The display area comprises a plurality of display pixels. Each of the display pixels corresponds to the interlaced first signal line and second signal line. The first dummy line is disposed on a first side of the display area and interlaced with the second signal lines. A section of the first dummy line between every two adjacent second signal lines among the second signal lines has an opening.

19 Claims, 6 Drawing Sheets

SYSTEMS FOR DISPLAYING IMAGES AND MANUFACTURING METHODS FOR DISPLAY PANELS

CROSS REFERENCE TO RELATED APPLICATIONS

This application claims the benefit of Taiwan application Serial No. 97131559 filed Aug. 19, 2008, the subject matter of which is incorporated herein by reference.

BACKGROUND

1. Technical Field

The disclosure relates to a system for displaying images, and more particularly to a display panel applied in systems for displaying images and a manufacturing method thereof.

2. Description of the Related Art

Static electricity effect occurs in display panels due to high temperature processes. Especially, edges of display areas within display panels are easily damaged by electrostatic discharge, resulting in generation of bright points. In conventional display panels, to prevent the display areas from being damaged by electrostatic discharge, dummy pixels are disposed on the periphery of the display areas to sustain electrostatic discharge.

As shown in FIG. 1, a display panel 1 comprises data lines D1-Dn, scan lines S1-Sm, dummy lines DL and DR, and a display area 10. The data lines D1-Dn are interlaced with the scan lines S1-Sm. The display area 10 comprises a plurality of display pixels, and each display pixel corresponds to one interlaced data line and scan line. The dummy lines DL and DR are interlaced with the scan lines S1-Sm. The interlaced dummy line and scan line correspond to one dummy pixel. Thus, the dummy pixels are disposed at two relative sides of the display area 10 for sustaining electrostatic discharge. If two of the dummy pixels on the same dummy line are damaged by electrostatic discharge, the two scan lines corresponding to the damaged dummy pixels are conducted through the dummy line. For example, the interlaced dummy line DL and scan line S1 correspond to a dummy pixel DP10, and the interlaced dummy line DL and scan line S3 correspond to a dummy pixel DP11. When the dummy pixels DP10 and DP11 are damaged by electrostatic discharge, the scan lines S1 and S3 are conducted through the dummy line DL, resulting in incorrect display of images in a display mode.

SUMMARY

An exemplary embodiment of a system for displaying images comprises a plurality of first signal lines, a plurality of second signal lines, a display area, and a first dummy line. The second signal lines are interlaced with the first signal lines. The display area comprises a plurality of display pixels. Each of the display pixels corresponds to the interlaced first signal line and second signal line. The first dummy line is disposed on a first side of the display area and interlaced with the second signal lines. A section of the first dummy line between every two adjacent second signal lines among the second signal lines has an opening.

An exemplary embodiment of a manufacturing method for a display panel comprises steps of: providing a substrate; forming a plurality of first signal lines and a plurality of second signal lines on the substrate, wherein the second signal lines are interlaced with the first signal lines; forming a display area on the substrate, wherein the display area comprises a plurality of display pixels, wherein each of the display pixels corresponds to the interlaced first signal line and second signal line; forming a first dummy line on a first side of the display area and on the substrate, wherein the first dummy line is interlaced with the second signal lines; and forming an opening on a section of the first dummy line between every two adjacent second signal lines among the second signal lines.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
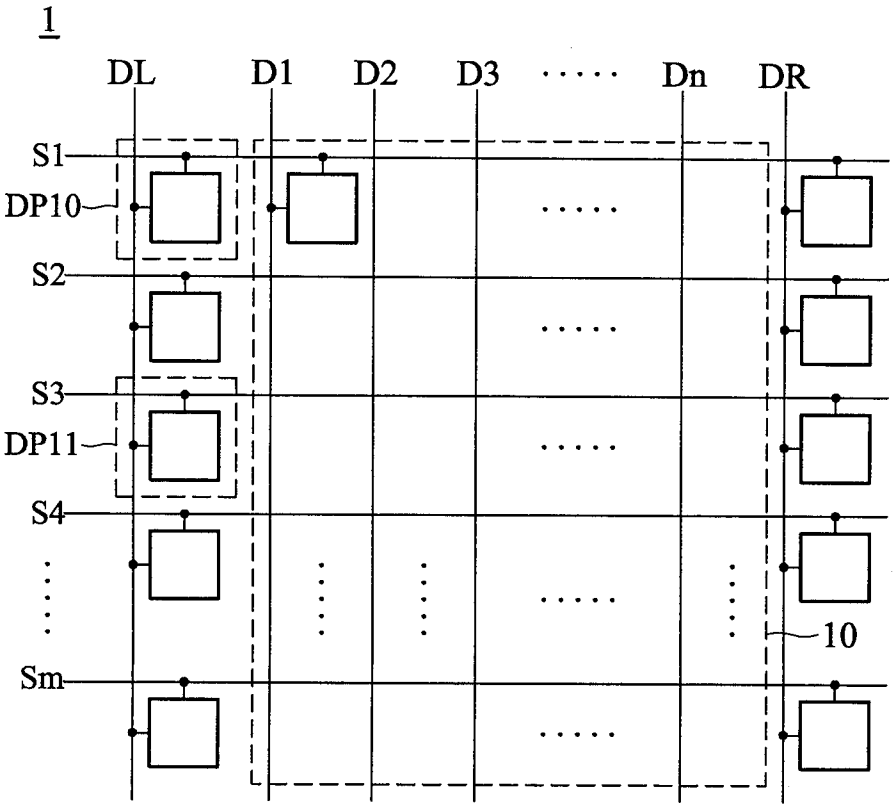
FIG. 1 (PRIOR ART)
FIG. 1 is a schematic view showing a conventional display panel with dummy pixels.
Figure 2:
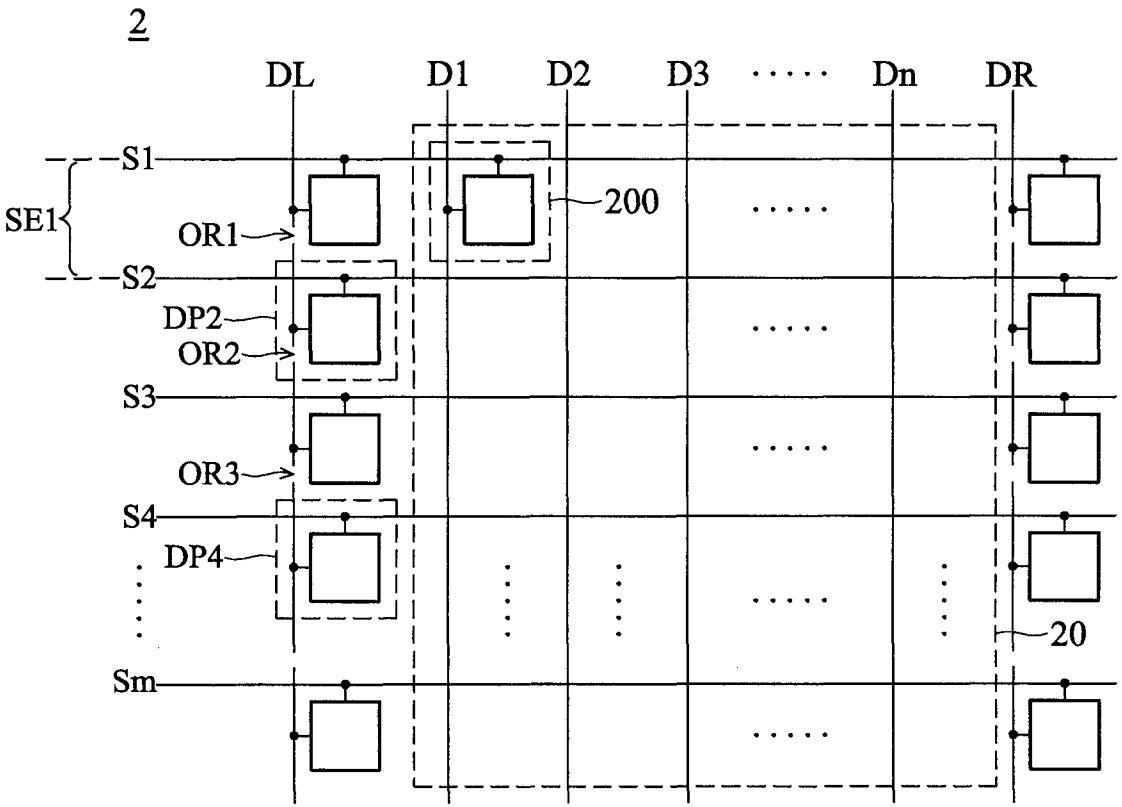
FIG. 2 is a schematic view showing an exemplary embodiment of a display panel.

Display panels are provided. In an exemplary embodiment of a display panel in FIG. 2, a display panel 2 comprises a plurality of data lines D1-Dn, a plurality of scan line S1-Sm, a display area 20, and at least one dummy line, which are disposed on a substrate (not shown in FIG. 2). Referring to FIG. 2, the data lines D1-Dn are interlaced with the scan lines S1-Sm. The display area 20 comprises a plurality of display pixels. One pixel corresponds to the interlaced data line and scan line. For example, a display pixel 200 corresponds to the interlaced data line D1 and scan line S1. The scan lines S1-Sm are arranged for providing scan signals to the display area 20 to turn on switching elements (not shown in FIG. 2) within the display pixels. When the switching elements are turned on, the data line D1-Dn provides image signals to the display pixels.

In the embodiment, two dummy lines DL and DR, which are respectively disposed at two opposite sides of the display area 20, are given as an example. The dummy line DL is interlaced with the scan lines S1-Sm, and each of the interlaced dummy line DL and scan line correspond to one dummy pixel. For example, the interlaced dummy line DL and scan line S2 correspond to a dummy pixel DP2, and the interlaced dummy line DL and scan line S4 correspond to a dummy pixel DP4. Similarly, the dummy line DR is interlaced with the scan lines S1-Sm, and the interlaced dummy line DR and scan line correspond to one dummy pixel.

Since the dummy line DL is interlaced with the scan lines S1-Sm, the dummy line DL is divided into a plurality of sections by the scan lines S1-Sm. Each section of the dummy line DL between every two adjacent scan lines has at least one opening. In the embodiment of FIG. 2, one opening is given as an example for each section of the dummy line DL between every two adjacent scan lines. For example, a section SE1 of the dummy line DL between the two adjacent scan lines S1 and S2 has an opening OR1. According to circuitry design, each section of the dummy line DL can have more than one opening.

Referring to FIG. 2, each section of the dummy line DL between every two adjacent scan lines has an opening. If two dummy pixels on the dummy line DL are damaged by electrostatic discharge simultaneously, the scan lines corresponding to the two damaged dummy pixels are not conducted through the dummy line DL due to the existence of the openings. For example, when the dummy pixels DP2 and DP4 are damaged by electrostatic discharge simultaneously, the scan lines S2 and S4 are not conducted through the dummy line DL because the section between the scan lines S2 and S3 has the opening OR 2 and the section between the scan lines S3 and S4 has the opening OR3.

Similarly, since the dummy line DR is interlaced with the scan lines S1-Sm, the dummy line DR is divided into a plurality of sections by the scan lines S1-Sm. Each section of the dummy line DR between two adjacent scan lines has at least one opening. In the embodiment, one opening is given as an example.

Accordingly, the embodiment of FIG. 2 provides a plurality of dummy pixels to sustain electrostatic discharge. Moreover, when at least two dummy pixels on the same dummy line are damaged by electrostatic discharge, the display area can display correct images, without being effected by the damaged dummy pixels.

Figure 3:
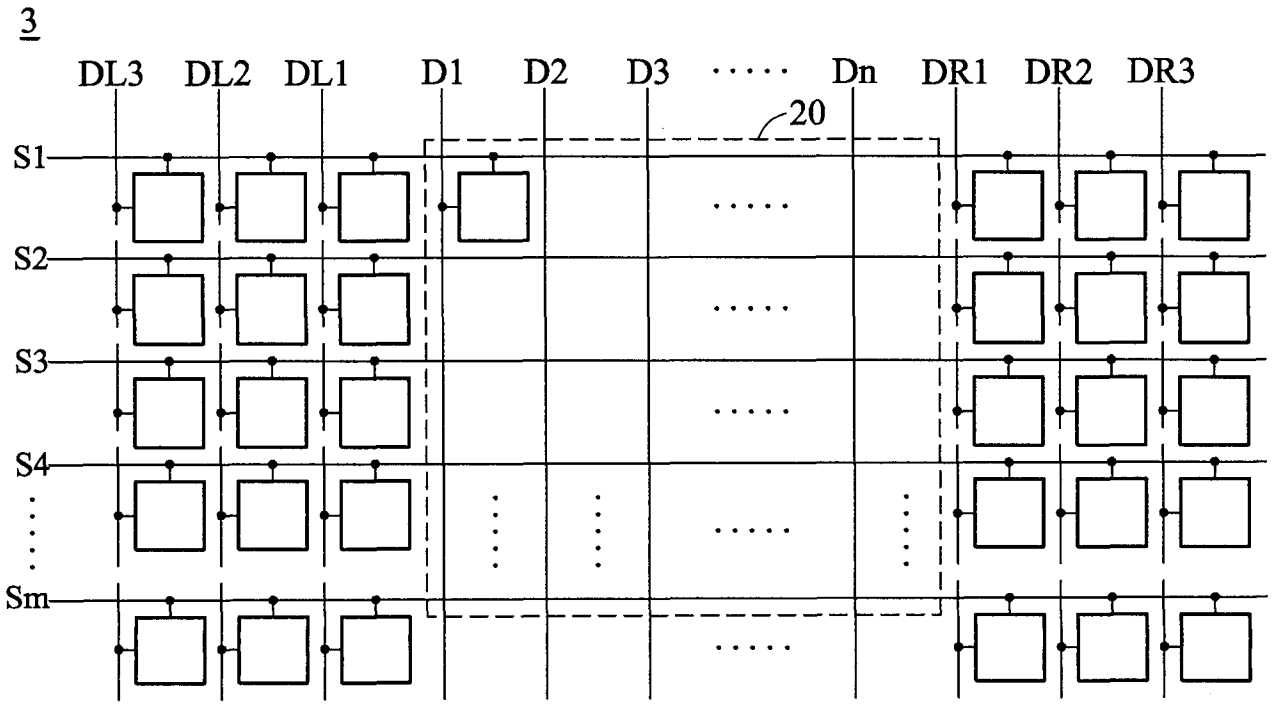
FIG. 3 is a schematic view showing another exemplary embodiment of a display panel.

In some embodiments, each of two opposite sides of the display area 20 has a plurality of dummy lines, as shown in FIG. 3. Referring to FIG. 3, dummy lines DL1-DL3 are disposed in a first side of the display area 20 and interlaced with the scan lines S1-Sm, while dummy lines DR1-DR3 are disposed on a second side of the display area 20 and interlaced with the scan lines S1-Sm, wherein the first side and second side of the display area 20 are opposite. Since each of the dummy lines DL1-DL3 and DR1-DR3 is interlaced with the scan lines S1-Sm, each dummy line is divided into a plurality of sections. Each section of the dummy lines DL1-DL3 and DR1-DR3 between every two adjacent scan lines has at least one opening. In the embodiment of FIG. 3, one opening is given as an example for each section of the dummy lines DL1-DL3 and DR1-DR3 between every two adjacent scan lines.

Figure 4:
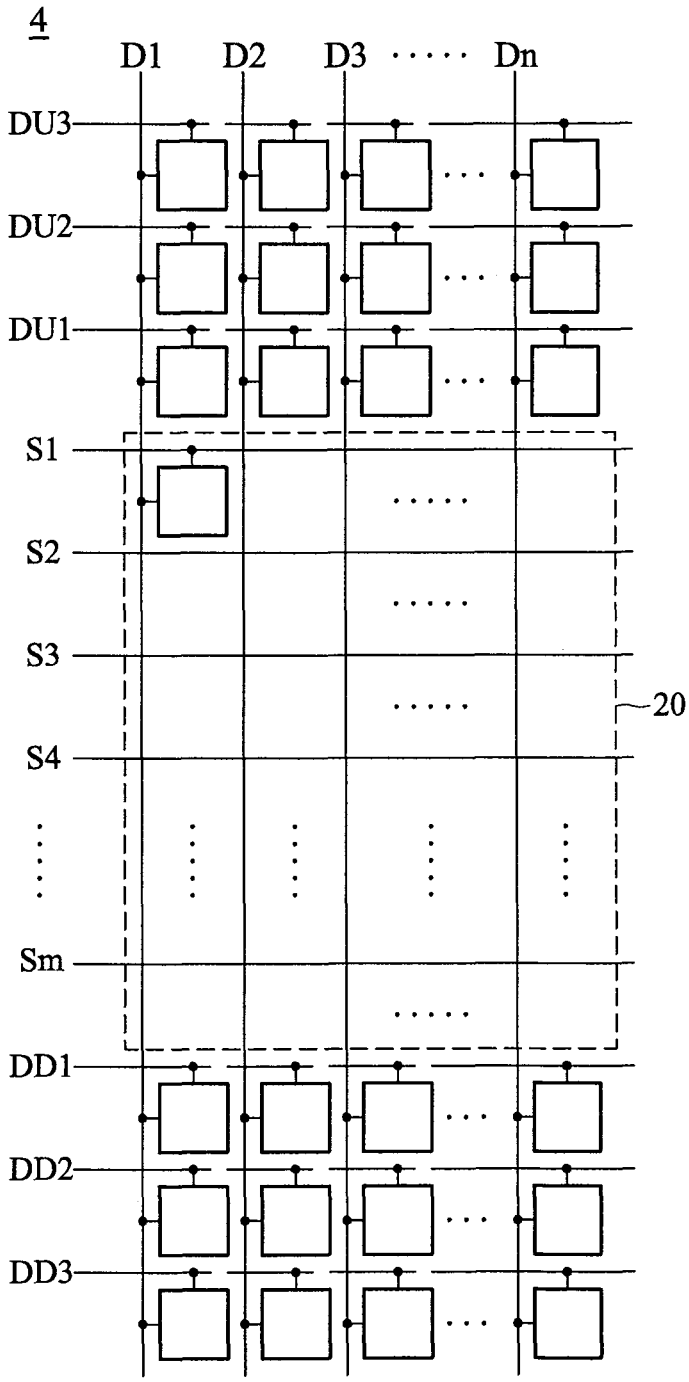
FIG. 4 is a schematic view showing another exemplary embodiment of a display panel.

FIG. 4 shows another exemplary embodiment of a display panel. Referring to FIG. 4, except for the disposition of dummy lines, the display panel 4 of FIG. 4 is similar to the display panel 2 of FIG. 2. The display panel 4 comprises at least one dummy line disposed in one side of the display area 20 and interlaced with the data line D1-Dn. In the embodiment, six dummy lines DU1-DU3 and DD1-DD3 are given as an example. The dummy lines DU1-DU3 are disposed on a first side of the display area 20 and interlaced with the data lines D1-Dn, while the dummy lines DD1-DD3 are disposed on a second side of the display area 20 and interlaced with the data lines D1-Dn, wherein the first side and second side of the display area 20 are opposite. The interlaced dummy and data line correspond to one dummy pixel. Each dummy line is divided into a plurality of sections by the interlaced data line D1-Dn, and each section of the dummy lines DU1-DU3 and DD1-DD3 between every two adjacent data lines has at least one opening. In the embodiment of FIG. 4, one opening is given as an example for each section of the dummy lines between every two adjacent data lines.

In the embodiment of FIG. 4, each section of the dummy lines DU1-DU3 and DD1-DD3 between every two adjacent data lines has an opening. When at least two dummy pixels on the same dummy line are damaged by electrostatic discharge, the display area can display correct images, without being effected by the damaged dummy pixels.

Figure 5:
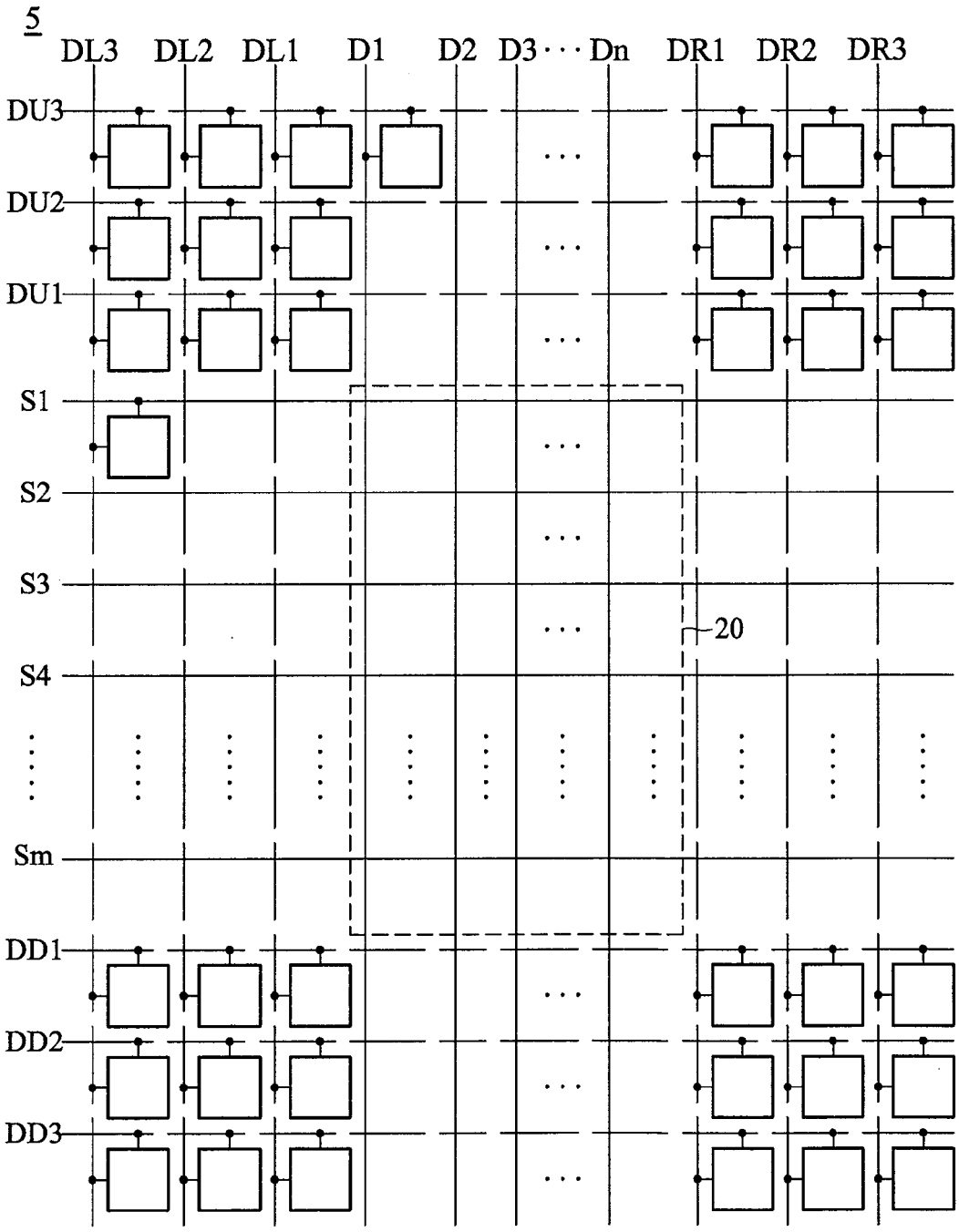
FIG. 5 is a schematic view showing another exemplary embodiment of a display panel.

In some embodiments, there are dummy lines disposed around a display area, as shown in FIG. 5. A display panel 5 comprises dummy lines DL1-DL3, DR1-DR3, DU1-DU3, and DD1-DD3. The dummy lines DL1-DL3 are disposed in a first side of the display 20 and interlaced with the scan lines S1-Sm, while the dummy lines DR1-DR3 are disposed in a second side opposite to the first side of the display 20 and interlaced with the scan lines S1-Sm. The interlaced dummy line and scan line correspond to one dummy pixel. For the dummy lines DL1-DL3 and DR1-DR3, each dummy line is divided into a plurality of sections by the interlaced scan lines S1-Sm, and each section of the dummy lines DL1-DL3 and DR1-DR3 between every two adjacent scan lines has at least one opening. In the embodiment of FIG. 5, one opening is given as an example for each section of the dummy lines between every two adjacent scan lines.

The dummy lines DU1-DU3 are disposed in a third side of the display 20 and interlaced with the data lines D1-Dn, while the dummy lines DD1-DD3 are disposed in a fourth side opposite to the third side of the display 20 and interlaced with the data lines D1-Dn. The interlaced dummy line and data line correspond to one dummy pixel. For the dummy lines DU1-DU3 and DD1-DD3, each dummy line is divided into a plurality of sections by the interlaced data lines D1-Dn, and each section of the dummy lines DU1-DU3 and DD1-DD3 between every two adjacent data lines has at least one opening. In the embodiment of FIG. 5, one opening is given as an example for each section of the dummy lines between every two adjacent data lines.

Moreover, referring to FIG. 5, the dummy lines DL1-DL3 and DR1-DR3 are interlaced with the dummy lines DU1-DU3 and DD1-DD3. For each of the dummy lines DL1-DL3, the section between the dummy line DU1 and the scan line S1 which is closest to the third side of the display area 20 has an opening. For each of the dummy lines DL1-DL3, the section between the dummy lines DU1 and DU2 has an opening, and the section between the dummy lines DU2 and DU3 has an opening. Similarly, for each of the dummy lines DL1-DL3, the section between the dummy line DD1 and the scan line Sm which is closest to the fourth side of the display area 20 has an opening, the section between the dummy lines DD1 and DD2 has an opening, and the section between the dummy lines DD2 and DD3 has an opening.

According to the same rule described above, for each of the dummy lines DR1-DR3, each of the sections between the dummy line DU1 and the scan line S1, between the dummy lines DU1 and DU2, between the dummy lines DU2 and DU3, between the dummy line DD1 and the scan line Sm, between the dummy lines DD1 and DD2, and between the dummy lines DD2 and DD3 has an opening.

For each of the dummy lines DU1-DU3, each of the sections between the dummy line DL1 and the data line D1, between the dummy lines DL1 and DL2, between the dummy lines DL2 and DL3, between the dummy line DR1 and the data line Dn, between the dummy lines DR1 and DR2, and between the dummy lines DR2 and DR3 has an opening.

For each of the dummy lines DD1-DD3, each of the sections between the dummy line DL1 and the data line D1, between the dummy lines DL1 and DL2, between the dummy lines DL2 and DL3, between the dummy line DR1 and the data line Dn, between the dummy lines DR1 and DR2, and between the dummy lines DR2 and DR3 has an opening.

Accordingly, the embodiment of FIG. 5 provides a plurality of dummy pixels to sustain electrostatic discharge. Moreover, when at least two dummy pixels on the same dummy line are damaged by electrostatic discharge, the display area can display correct images, without being effected by the damaged dummy pixels.

Figure 6:
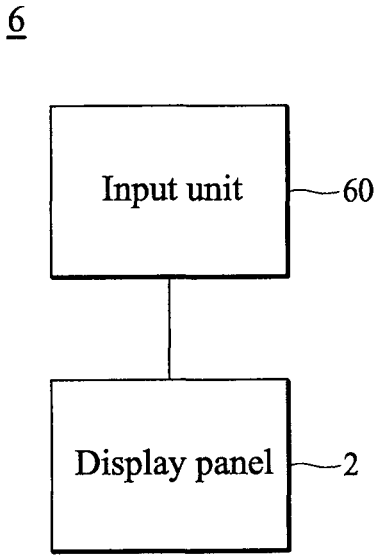
FIG. 6 is a schematic view showing an exemplary embodiment of a system for displaying images.

FIG. 6 shows an exemplary embodiment of a system for displaying images. The system for displaying images is implemented by an electronic device 6. As shown in FIG. 5, the electronic device 6 comprises any one of the display panels of FIGS. 2-5 and an input unit 60. In the embodiment of FIG. 6, the display panel 2 is given as an example for description. The input unit is coupled to the display panel 2 and receives image data for displaying in the display panel 2. For example, the electronic device 6 can be a digital camera, a portable DVD displayer, a television, an automotive displayer, a personal digital assistant (PDA), a display monitor, a notebook computer, a tablet computer, or a cellular phone.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A system for displaying images comprising:

a plurality of first signal lines;

a plurality of second signal lines interlaced with the first signal lines;

a display area comprising a plurality of display pixels, wherein each of the display pixels corresponds to the interlaced first signal line and second signal line; and a first dummy line disposed on a first side of the display area and interlaced with the second signal lines, wherein a section of the first dummy line between every two adjacent second signal lines among the second signal lines has an opening.

2. The system as claimed in claim 1, wherein the second signal lines are scan lines for turning on a switching element of the display area, and the first signal lines are data lines for providing image signals to the display pixels of the display area through the switching element.

3. The system as claimed in claim 1, wherein the first signal lines are scan lines for turning on a switching element of the display area, and the second signal lines are data lines for providing image signals to the display pixels of the display area through the switching element.

4. The system as claimed in claim 1 further comprising a second dummy line disposed on a second side of the display area opposite to the first side and interlaced with the second signal lines, wherein a section of the second dummy line between every two adjacent second signal lines among the second signal lines has an opening.

5. The system as claimed in claim 4, further comprising:

a third dummy line disposed on a third side of the display area and interlaced with the first signal lines; and a fourth dummy line disposed on a fourth side of the display area opposite to the third side and interlaced with the first signal lines;

wherein a section of the third dummy line between every two adjacent first signal lines among the first signal lines has an opening, and wherein a section of the fourth dummy line between every two adjacent first signal lines among the first signal lines has an opening.

6. The system as claimed in claim 5, wherein the third and fourth dummy lines are interlaced with the first and second dummy lines.

7. The system as claimed in claim 6, wherein a section of the first dummy line between the third dummy line and the second signal line closest to the third side has an opening, and a section of the first dummy line between the fourth dummy line and the second signal line closest to the fourth side has an opening; and wherein a section of the second dummy line between the third dummy line and the second signal line closest to the third side has an opening, and a section of the second dummy line between the fourth dummy line and the second signal line closest to the fourth side has an opening.

8. The system as claimed in claim 7, wherein a section of the third dummy line between the first dummy line and the first signal line closest to the first side has an opening, and a section of the third line between the second dummy line and the first signal line closest to the second side has an opening; and wherein a section of the fourth dummy line between the first dummy line and the first signal line closest to the first side has an opening, and a section of the fourth dummy line between the second dummy line and the first signal line closest to the second side has an opening.

9. The system as claimed in claim 1 further comprising a display panel, wherein the display panel comprises the first signal lines, the second signal lines, the display area, and the first dummy line.

10. The system as claimed in claim 9 further comprising an electronic device, wherein the electronic device comprises:

the display panel; and an input unit coupled to the display panels and receiving image data for displaying images on the display panel.

11. The system as claimed in claim 10, wherein the electronic device is a digital camera, a portable DVD displayer, a television, an automotive displayer, a personal digital assistant (PDA), a display monitor, a notebook computer, a tablet computer, or a cellular phone.

12. A manufacturing method for a display panel comprising:

providing a substrate;

forming a plurality of first signal lines and a plurality of second signal lines on the substrate, wherein the second signal lines are interlaced with the first signal lines;

forming a display area on the substrate, wherein the display area comprises a plurality of display pixels, wherein each of the display pixels corresponds to the interlaced first signal line and second signal line;

forming a first dummy line on a first side of the display area and on the substrate, wherein the first dummy line is interlaced with the second signal lines; and forming an opening on a section of the first dummy line between every two adjacent second signal lines among the second signal lines.

13. The manufacturing method as claimed in claim 12 further comprising:

turning on a switching element of the display area through the second signal lines; and providing image signals to the display pixels of the display area through the first signal lines.

14. The manufacturing method as claimed in claim 12 further comprising:

turning on a switching element of the display area through the first signal lines; and providing image signals to the display pixels of the display area through the second signal lines.

15. The manufacturing method as claimed in claim 12 further comprising:

forming a second dummy line on a second side of the display area opposite to the first side and on the substrate, wherein the second dummy line is interlaced with the second signal lines; and forming an opening on a section of the second dummy line between every two adjacent second signal lines among the second signal lines.

16. The manufacturing method as claimed in claim 15 further comprising:

forming a third dummy line on a third side of the display area and on the substrate, wherein the third dummy line is interlaced with the first signal lines;

forming an opening on a section of the third dummy line between every two adjacent first signal lines among the first signal lines;

forming a fourth dummy line on a fourth side of the display area opposite to the third side and on the substrate, wherein the fourth dummy line is interlaced with the first signal lines; and forming an opening on a section of the fourth dummy line between every two adjacent first signal lines among the first signal lines.

17. The manufacturing method as claimed in claim 16, wherein the third and fourth dummy lines are interlaced with the first and second dummy lines.

18. The manufacturing method as claimed in claim 17 further comprising:

forming an opening on a section of the first dummy line between the third dummy line and the second signal line closest to the third side;

forming an opening on a section of the first dummy line between the fourth dummy line and the second signal line closest to the fourth side;

forming an opening on a section of the second dummy line between the third dummy line and the second signal line closest to the third side; and forming an opening on a section of the second dummy line between the fourth dummy line and the second signal line closest to the fourth side.

19. The manufacturing method as claimed in claim 18 further comprising:

forming an opening on a section of the third dummy line between the first dummy line and the first signal line closest to the first side;

forming an opening on a section of the third dummy line between the second dummy line and the first signal line closest to the second side;

forming an opening on a section of the fourth dummy line between the first dummy line and the first signal line closest to the first side; and forming an opening on a section of the fourth dummy line between the second dummy line and the first signal line closest to the second side.

* * * * *